United States Patent [19]

Lachonius

[11] 4,263,976

[45] Apr. 28, 1981

[54] ROTARY DRILL BIT WITH ROTARY CUTTERS

[75] Inventor: Leif Lachonius, Surte, Sweden

[73] Assignee: Sandvik AB, Fack & Aktiebolaget SKF, Gothenburg, Sweden

[21] Appl. No.: 42,926

[22] Filed: May 29, 1979

[51] Int. Cl.[3] ..... E21B 10/22

[52] U.S. Cl. ..... 175/370; 175/372; 308/8.2

[58] Field of Search ..... 175/227, 228, 229, 370, 175/371, 372, 37; 308/8.2

[56] References Cited

U.S. PATENT DOCUMENTS

| | | | |
|---|---|---|---|
| 2,076,000 | 4/1937 | Reed | 308/35 X |
| 2,194,675 | 3/1940 | Sanders et al. | 308/8.2 |
| 2,676,790 | 4/1954 | Turner | 175/227 X |
| 3,601,456 | 8/1971 | Becker | 308/8.2 |

*Primary Examiner*—James A. Leppink
*Assistant Examiner*—Richard E. Favreau
*Attorney, Agent, or Firm*—Eugene E. Renz, Jr.

[57] ABSTRACT

A rotary drill bit having a drill bit body and at least one trunnion projecting from the drill bit body and a rotary cutter supported on at least one radial roller bearing on the trunnion. The rolling elements of the bearing are guided on at least one axial end facing the drill bit body in an outer bearing race groove incorporated in the bore of the rotary cutter. The inner bearing race groove is formed on the trunnion for the rolling elements of the radial roller bearing. At least one filling opening is provided which extends through the drill bit body and trunnion and is essentially axially oriented having one terminal end adjacent the inner bearing race groove and at least one pair of filler piece for sealing the opening. One of the filler pieces is made of an elastically compressible material.

9 Claims, 3 Drawing Figures

ROTARY DRILL BIT WITH ROTARY CUTTERS

BACKGROUND OF THE INVENTION

The present invention relates to drilling apparatus used in the exploration of underground petroleum reserves and more specifically to a rotary drill bit having a plurality of rotary cutters supported for rotation on the drill bit body by a plurality of rolling elements, the rolling elements being laterally guided at least at their axial ends facing the drill bit body in a radially disposed outer bearing race groove incorporated in the bore of the rotary cutter.

Rotary drill bits having conically shaped rotary cutters are known wherein the rotary cutters are supported on a trunnion formed integrally with the drill bit body and a radial roller bearing. The rollers of this bearing are laterally guided in a bearing race groove in the bore of the rotary cutter and supported in place at their axial ends facing away from the drill bit body by means of a flange bolt secured in the trunnion so that each rotary cutter is mounted in a manner preventing removal from the trunnion. An arrangement of this type is shown in the British Pat. No. 465,570. This known assembly has several disadvantages and drawbacks. For example, the construction requires that the flange bolt be shaped in the form of a race element for the axial bearing of the rotary cutter and be made of an expensive bearing material. In order to mount the flange bolt in a precise manner in the trunnion, the bolt has to be machined with close tolerances. Thus, the method of manufacturing is relatively costly. Additionally, a center bore with a relatively large diameter must be provided in the trunnion to receive the highly stressed flange bolt and accordingly, the trunnion of the drill bit body is somewhat weakened and consequently there is the risk of trunnion failure by breakage especially in heavy duty operations.

In accordance with another known rotary drill bit assembly, the rotary cutters are each supported on a trunnion connected in one piece with the drill bit body in a radial roller bearing with conical roller elements. This arrangement is shown in U.S. Pat. No. 2,076,000. This arrangement has the advantage of providing a trunnion which is relatively rigid and possesses good load bearing characteristics. However, a so-called edge ring is required which is located in the bore of the rotary cutter on the side of the roller elements facing the drill bit body which axially guides the roller elements to support the rotary cutter in place on the trunnion. It has been found that the fabrication of the rotary cutter is rather expensive because of the incorporation of the additional edge ring. Furthermore, in heavy duty operations with high impact stresses, it has been observed that a seizing of the edge ring may result and accordingly, presents the disadvantage that the rotary cutter is not adequately secured against being drawn off the trunnion.

SUMMARY OF THE INVENTION

With the foregoing in mind, it is an object of the present invention to provide an improved rotary drill bit which is characterized by novel features of construction and arrangement including a novel filler piece assembly which may be elastically compressed during insertion in the filling opening and thus can be assembled without having to maintain close finishing tolerances between the filler piece and filling opening.

In accordance with the present invention, the filler piece assembly comprises an inner filler piece which can be extensively radially elastically compressed since the material of the inner filler piece can give way radially inwardly in the direction of the bore and after inserting the elastic filler piece, the filling opening can be sealed with a rigid outer filler piece, the extended projections of which engage into the bore of the elastic filler piece and expands the filler piece so that is wedged into the opening. Consequently, a firm seating of the inside filler piece in the filling opening is always obtained in spite of economically broad finishing tolerances of the filling opening and filler piece and still provide a firm and accurate seal with the appropriate bearing race groove in the trunnion.

In a rotary drill bit constructed in accordance with the present invention, the rolling elements of the radial roller bearings are guided between the edges of the inside bearing race groove, are firmly supported on the trunnion and are laterally held in place. In this manner there is no danger of seizing of the bearing race groove edges. The trunnion has a filling opening for insertion of the rolling elements of the radial roller bearings which is of comparatively small diameter and does not detract appreciably from the strength of the trunnion. The trunnion of each rotary cutter may be constructed in one piece with the drill bit body thus providing a further simplification of the fabrication and assembly of the roller bit since the assembly comprises relatively few parts. These parts are comparatively easy to machine so that the fabrication and assembly of the rotary drill bit is simple and economical.

In the rotary drill bit of the present invention the outside bearing race groove in the rotary cutter as well as the inside bearing race groove on the trunnion of the radial roller bearings have a relatively large groove depth providing a good lateral guidance of the rolling elements and strong impact resistant edges of the bearing race grooves. The filling opening for the rolling elements in the trunnion is of optimally small cross section and does not harmfully effect the good strength charactertistics of the trunnion. Further the filling opening disposed in the machined bearing race groove is located in the unstressed zone of the radial roller bearing so that the load bearing ability of the radial roller bearing is not effected by this filling opening. Additionally, the filling opening is adjacent the inside heavy walled portion of the drill bit body so that a relatively strong break-proof connection is guaranteed between the trunnion and the drill bit body.

BRIEF DESCRIPTION OF THE DRAWINGS

These and other objects of the present invention of the various features and details of the operation and construction thereof are hereinafter more fully set forth with reference to the accompanying drawings, wherein.

DESCRIPTION OF THE PREFERRED EMBODIMENT

Figure 1:
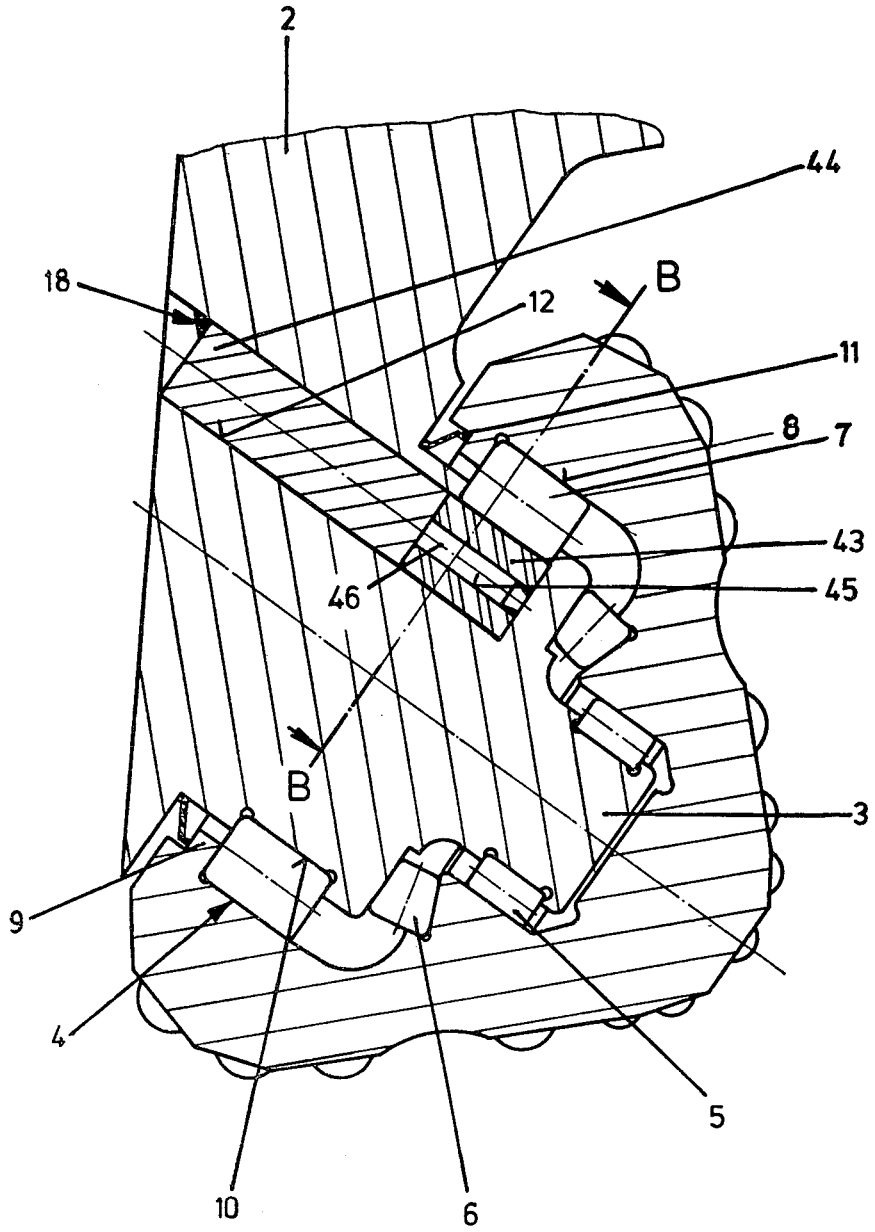
FIG. 1 is a fragmentary longitudinal sectional view of a rotary drill bit in accordance with the present invention.

Referring now to the drawings and particularly to FIG. 1 thereof, there is illustrated one of a plurality of conical rotary cutters of a rotary drill bit constructed in accordance with the present invention. As illustrated, the rotary cutter which is generally designated by the numeral 1 is rotatably supported on the trunnion 3, which, in the present instance, is formed integrally with the drill bit body 2. The bearing support illustrated includes an outer roller bearing 4 with cylindrical rolling elements 7, an inner radial bearing 5 with cylindrical rolling elements and intermediate axial bearing 6 with conical rolling elements. The rollers 7 of the outer radial roller bearing 4 facing the drill bit body run in the base of the outer bearing race groove 8 formed radially in the rotary cutter 1. The axial end of the rollers 7 which face the drill bit body 2 are guided by a radially inwardly directed shoulder 9 of the bearing race groove 8 which as illustrated is formed integrally with the rotary cutter 1. The trunnion is formed with a bearing race groove 10 for the rollers 7 of the radial bearing 4 so that rollers 7 are guided and held in place on both sides in the bearing race groove 10. By this construction, the rotary cutter 1 is secured against being drawn off the trunnion 3 by the shoulder 9 and the rollers 7. The inner end of the rotary cutter is provided with a pocket opposite the shoulder 9 to receive an annular seal 11 which as illustrated engages and slides on the opposite confronting front surface of the drill bit body 2 to seal the entire bearing space of the rotary cutter against ingress of foreign matter from the outside of the assembly.

Means is provided for filling the outer radial bearing with the rollers via the trunnion. To this end, an axially extending filling opening 12, in the present instance, of circular cross section is bored in the trunnion 3 and extends from the outer end face of the rotary cutter 1 to the bearing groove 10. The cylindrical filling opening 12 is sealed in this case, with an inside filler piece 43 of an elastically compressible material such as, for example, rubber or plastic which comes to rest under the roller bodies 7 of the radial roller bearing 4 and an outside filler piece 44, for example, of a weldable carbon steel.

Figure 3:
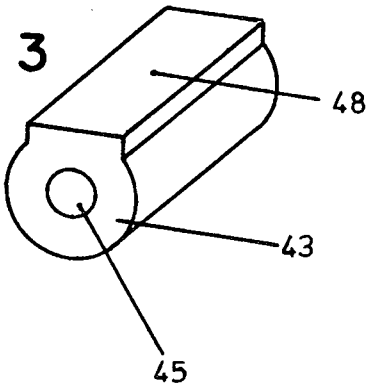
FIG. 3 is a perspective view of the inside filler piece of the rotary drill bit of FIGS. 1 and 2.
Figure 2:
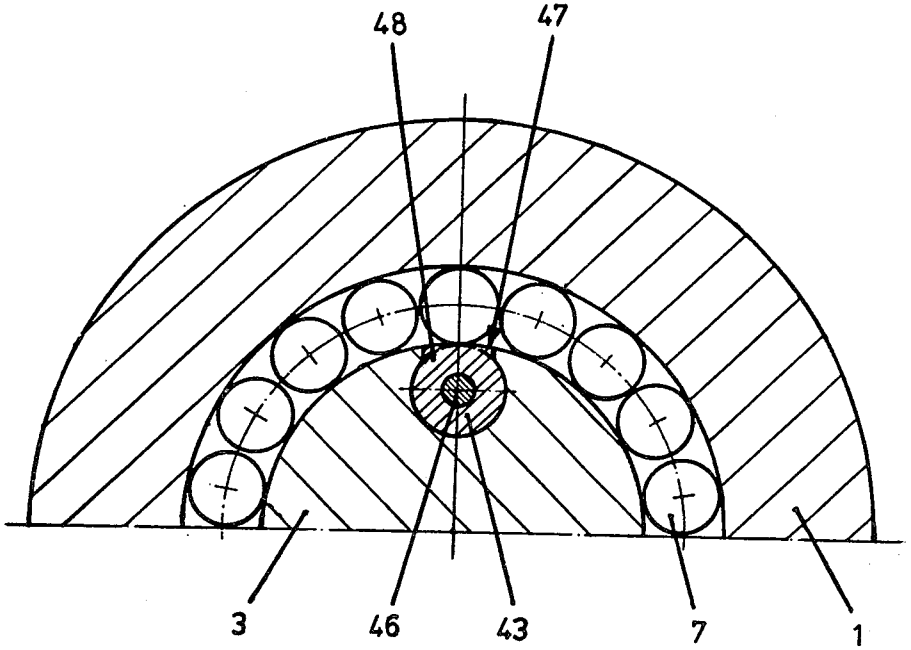
FIG. 2 is a fragmentary cross-sectional view taken on lines B—B of FIG. 1.

As can be clearly seen in FIG. 2 and 3, the inside filler piece 43 has a center bore 45 pointing in the direction of the longitudinal axis of the cylindrical filling opening 12 in which an extended projection 46 of the adjacent outside filler piece engages with radial oversize.

After inserting the roller bodies 7 between rotary cutter 1 and trunnion 3, the elastically compressible inside filler piece 43 is radially compressed while narrowing down its bore 45 and is placed into the filling opening 12. Next, the filler piece 43 is pushed to the inside end of the filling opening 12. Here a radial projection 48 of the filler piece 43 snaps into the radial connecting orifice 47 which exits into the bearing race groove 10 of the radial roller bearing 7 so that this connecting orifice 47 is at least partly sealed by the filler piece 43. Then, the outside filler piece is pushed into the filling opening 12. The extended projection 46 of the filler piece 44 is pressed into the bore 45 in this way so that the elastically compressible filler piece 43 slightly expands and comes, therefore, in tight contact with the walls of the connecting orifice 47. In this way, a firm seating of the inside filler piece 43 in the filling opening 12 with connecting orifice 47 is obtained without having to maintain expensive close finishing tolerances between filler piece 43 and filling opening 12. After inserting the outside filler piece 44, this can be firmly connected with the drill bit body 2 by means of welds 18.

The rotary drill bit according to the invention has the distinct advantage that it is equipped with rotary cutters in a simple economic fabrication, which are held in place securely and impact resistant against being drawn off their trunnion via the roller bodies of at least one radial roller bearing.

Moreover, the rotary drill bit according to the invention is not limited to the above described exemplified embodiments. It can rather be modified within the scope of the basic concept of the invention. For example, it is possible to insert through a common filling opening running essentially parallel to the axis of rotation of the rotary cutter, the rolling elements of more than two radial roller bearings between trunnion and rotary cutter whereby the filling opening exits then in all bearing races of the appropriate roller bearings. The filling opening can in addition also be used to insert the roller bodies of one or more axial roller bearings. The rolling elements of the individual roller bearings do not have to be constructed without cage, in other words, rolls or spheres, they can rather be guided by conventional cages, segement or spacers.

Instead of a common filling opening for the roller bodies of several radial roller bearings, an essentially axially running filling opening exiting into the appropriate bearing race groove of the trunnion can be provided for each individual radial roller bearing in a rotary cutter. The strength of the trunnion is then, of course, reduced in comparison with the common filling opening for several radial roller bearings through the single filling openings.

What is claimed is:

1. In a rotary drill bit having a drill bit body and at least one trunnion projecting from the drill bit body and a rotary cutter supported on at least one radial roller bearing on the trunnion, means for guiding the rolling elements of said bearing on at least one axial end facing the drill bit body in an outer bearing race groove incorporated in the bore of the rotary cutter, means defining an inner bearing race groove on the trunnion for the rolling elements of said radial roller bearing and means defining at least one filling opening extending through the drill bit body and trunnion extending essentially axially having one terminal end adjacent the inner bearing race groove and at least a pair of filler pieces for sealing the opening, one of said filler pieces being made of an elastically compressible non-rigid material and located in the inner bearing race groove on the trunnion which upon application of a comparatively small load readily deforms to conform to said filler opening configuration.

2. In a rotary drill bit as claimed in claim 1 wherein said one filler piece is made of rubber.

3. In a rotary drill bit as claimed in claim 1 wherein said one filler piece is made of plastic.

4. In a rotary drill bit as claimed in claim 1 wherein said other filler piece is made of a rigid material and is adapted to compress and deform said one filler piece when pressed into said filling opening.

5. In a rotary drill bit as claimed in claim 4 wherein said one filler piece has a bore aligned with longitudinal axis of said filling opening and wherein said other filler piece has a projection arranged to engage in said bore with radial oversize.

6. In a rotary drill bit having a drill bit body and at least one trunnion projecting from the drill bit body and a rotary cutter supported on at least one radial roller bearing on the trunnion, means for guiding the rolling elements of said bearing on at least one axial end facing the drill bit body in an outer bearing race groove incorporated in the bore of the rotary cutter comprising a continuous flange on the cutter disposed adjacent the outer bearing race groove and projecting radially inwardly thereof to confront the axial end face of said rolling elements facing the drill bit body, means defining an inner bearing race groove on the trunnion for the rolling elements of said radial roller bearing and means defining at least one filling opening extending through the drill bit body and trunnion extending essentially axially having one terminal end adjacent the inner bearing race groove and at least one filler piece for sealing the opening.

7. In a rotary drill bit as claimed in claim 6 wherein said radial roller bearing comprises a plurality of cylindrical rollers.

8. In a rotary drill bit as claimed in claim 6 including a seal between the drill bit body and said continuous flange to prevent ingress of foreign matter to the annular space between the trunnion and the cutter.

9. In a rotary drill bit as claimed in claim 6 wherein said trunnion and drill bit body are formed as one integral member.

* * * * *